United States Patent [19]

Verne

[11] Patent Number: 4,551,569

[45] Date of Patent: Nov. 5, 1985

[54] TELECOMMUNICATION CABLE FILLING COMPOSITION

[75] Inventor: Stefan Verne, London, England

[73] Assignee: BICC Public Limited Company, London, England

[21] Appl. No.: 645,163

[22] Filed: Aug. 28, 1984

Related U.S. Application Data

[63] Continuation of Ser. No. 400,480, Jul. 21, 1982, abandoned, which is a continuation of Ser. No. 177,925, Aug. 13, 1980, Pat. No. 4,356,342, which is a continuation-in-part of Ser. No. 87,437, Oct. 22, 1979, abandoned, which is a continuation-in-part of Ser. No. 952,590, Oct. 18, 1978, abandoned.

[51] Int. Cl.[4] ..... H01B 3/22; H01B 11/02

[52] U.S. Cl. ..... 585/6.6; 156/48; 174/23 C; 174/25 C; 252/570; 585/6.3

[58] Field of Search ..... 585/6.3, 6.6; 252/570; 174/23 C, 25 C; 156/48

[56] References Cited

U.S. PATENT DOCUMENTS

| | | | |
|---|---|---|---|
| 3,733,427 | 5/1973 | Clark et al. | 174/23 C |
| 3,775,548 | 11/1973 | Zinser, Jr. et al. | 174/25 C |
| 3,830,953 | 8/1974 | Wood et al. | 174/23 C |
| 3,856,980 | 12/1974 | Puckowski et al. | 174/23 C |
| 3,893,839 | 7/1975 | Elliot et al. | 106/272 |
| 3,904,541 | 9/1975 | Charlton | 252/63.2 |
| 4,105,619 | 8/1978 | Kaufman et al. | 260/33.6 PQ |
| 4,246,435 | 1/1981 | Thompson | 174/23 C |
| 4,319,071 | 3/1982 | Schmidt | 174/23 C |

FOREIGN PATENT DOCUMENTS

| | | |
|---|---|---|
| 1039891 | 10/1978 | Canada . |
| 58022 | 8/1982 | European Pat. Off. . |
| 2320254 | 11/1974 | Fed. Rep. of Germany . |
| 2161047 | 7/1973 | France . |
| 811133 | 4/1959 | United Kingdom . |
| 995582 | 6/1965 | United Kingdom . |
| 1364200 | 8/1974 | United Kingdom . |

OTHER PUBLICATIONS

C. K. Eoll, "The Ageing of Filled Cable with Cellular Insulation", 27th International Wire & Cable Symposium, 1978.

Collins & Apen, "A Complete Waterproof Cable System for Construction of Buried Loops", 2nd International Symposium on Subscriber Loops & Services–1976.

Anderka et al., "Change of Crosstalk Properties in Correlation to the Interaction of Polyethylene/Petroleum Jelly", 24 International Wire & Cable Symposium, 1975.

Grill, "Ageing of Polyethylene Insulation", Electrical Communication, vol. 52, No. 1, p. 80, 1977.

Gouldson et al., "Foam-Skin, A Composite Expanded Insulation for Use in Telephone Cables", 21st International Wire & Cable Symposium, 1972.

Anaconda Engineering Bulletin EB52-0, "New Developments in Filled Cables".

Foord, "Compatibility Problems in Filled Cellular Polyolefine Insulated Telephone Cables", 22nd International Wire & Cable Symposium, 1977.

Olszewski, "Immunity to Water of Foam, Foam-skin and Solid Insulated Filled Telephone Cable", 26th International Wire & Cable Symposium, 1977.

(List continued on next page.)

*Primary Examiner*—Paul Lieberman
*Assistant Examiner*—Robert A. Wax
*Attorney, Agent, or Firm*—Buell, Ziesenheim, Beck & Alstadt

[57] ABSTRACT

Waterproof filling medium, used in telecommunication cables with cellular insulation of polyethylene or polypropylene, is based on a mineral oil (with or without a gelling agent such as microcrystalline wax) and includes two non-polar additives. The first is soluble and of low enough molecular weight to reduce significantly the osmotic pressure of the base, but does not diffuse into the insulation below 80° C.; and the second is polymeric and of high enough molecular weight to increase the resistance to flow to obtain the required non-draining property. Filling of cells in the insulation is inhibited.

5 Claims, 2 Drawing Figures

OTHER PUBLICATIONS

Aloisio et al., "Effect of Water and Petroleum Jelly Migration on Capacitance of Plastic Insulated Cables", 22nd International Wire & Cable Symposium, 1973.

Repp, "Wechselwirkung Verzellter, Polyathylenisolieter Nachrichtenadern mit Petrolaten", Siemens Forsch.-u Entwickl,-Ber., vol. 4, No. 5, 1975.

Molleda et al., "Filled Cable for Aerial Installation", 25th International Wire & Cable Symposium, 1976.

Mangaraj et al., "The Effect of Filling Compound Migration on Cellular Insulation", 27th International Wire & Cable Symposium, 1978.

S. M. Beach et al., "The Properties of Cellular Polyethylene Insulated Filled Communication Cable and Its Increasing Use", 24th International Wire & Cable Symposium, 1975.

Tenzer et al., "Analysis of Long-Term Stability of Expanded Insulations in Filled Cables", 28th International Wire & Cable Symposium, 1979.

TELECOMMUNICATION CABLE FILLING COMPOSITION

RELATED APPLICATIONS

This application is a continuation of my application Ser. No. 400,480 filed July 21, 1982, now abandoned, which was a continuation of my application Ser. No. 177,925 filed Aug. 13, 1980, now U.S. Pat. No. 4,356,342, which was a continuation in-part of my application Ser. No. 087,437 filed Oct. 22, 1979, abandoned, which was in turn a continuation-in-part of my application Ser. No. 952,590, filed Oct. 18, 1978, abandoned.

BACKGROUND OF THE INVENTION

This invention relates to fully-filled telecommunication cables and to compositions for use as a filling medium in them. These cables comprise a multiplicity of conductors each insulated with cellular polyethylene or polypropylene and enclosed in a sheath, the interstices between the insulated conductors, and between them and the sheath, being filled with a waterproof filling medium.

Such cables usually have insulation of cellular polyethylene or cellular polypropylene, which have surface energies of about $32\times10^{-3}$ J/m$^2$ and $30\times10^{-3}$ J/m$^2$ respectively. If the filling medium is to be effective it must wet the surface of the insulation, and this implies that it must have a free-surface energy lower than that of the insulation. Hydrocarbon oils gelled with waxes or other suitable gelling agents, and especially petroleum jelly, with a surface energy of about $28\times10^{-3}$ J/m$^2$, are amongst the few non-volatile materials that satisfy this requirement as well as the other important requirements of low permittivity and low dielectric loss. Petroleum jelly has other desirable properties and has been found entirely satisfactory for cables operating at temperatures of up to about 50° C.

In some cases, however, it is desirable to use fullyfilled cables at temperatures up to about 80° C.—for example when they are associated with and run alongside large power cables—and is this case two difficulties arise: first petroleum jelly (which is largely molten at these temperatures) shows a tendency to fill cells in the insulation to an extent that may be appreciable in a few months; and second the viscosity of the medium decreases to the point at which it may flow along the interstices under the hydrostatic pressures that may occur in an installed cable.

Attempts have been made to overcome these problems by increasing the effective viscosity of the gelled oil by incorporating into it soluble high polymers or mineral powders that impart thixotropic character. These measures have been reasonably successful in preventing flow of the gelled oil, but have had only a marginal effect on the temperature at which cell filling is observed.

SUMMARY OF THE INVENTION

The present invention arises from the realisation that if the filling medium contains a substance or substances capable of diffusing through the solid insulating material an osmotic equilibrium tends to be established between the medium outside the insulation and the material that penetrates to the surface of the cells and that, if the osmotic pressure of the latter is substantially the same as that of the medium outside, the cells will necessarily fill under the influence of the associated enhanced surface tension and reduced vapour pressure at the curved surface inside the cell.

The filling medium of the cable in accordance with the invention has a base comprising a hydrocarbon oil and is characterised by the use of two non-polar additives, namely:

(i) a first additive which is soluble and consists substantially of molecules that are substantially incapable of diffusing into polyethylene or polypropylene at temperatures of up to 80° C. but having a low enough (number average) molecular weight to reduce significantly the osmotic pressure of the base, this additive having no appreciable useful effect on the composition's resistance to flow at temperatures in the range 50°-80° C.; and (ii) a second additive which is polymeric and has a high enough (viscosity average) molecular weight to raise the resistance to flow of the composition so that the cable will pass a water-penetration test as defined in Post Office Telecommunications Specification No. CW236 (issued by the Post Office Corporation in Great Britain and more specifically set out hereafter) not only at room temperature but also at temperatures up to a limit that is higher than 50° C.

Preferably the temperature limit is considerably higher than 50° C. In most cases we prefer it to be about 80° C. in order to produce cables with the highest possible maximum working temperature. However when this is not essential it may be economically desirable to use a smaller proportion of the second additive so that the temperature limit for the water penetration test will be lower (e.g. 65° or 70° C.).

The base may be hydrocarbon oil alone, in which case the second additive will serve as a gelling agent, or alternatively the base may already include a gelling agent such as microcrystalline wax, which is the gelling agent of "natural" petroleum jelly. Mineral oils are usually preferred, but the use of suitable synthetic hydrocarbon oils such as alkylbenzenes is not excluded.

Preferably the second additive, as well as the first, is soluble in the base.

Preferably both additives are hydrocarbon polymers of suitable molecular weights. Polymeric silicone oils are also satisfactory (especially for the first additive), but they are much more expensive. More specifically, polybutene oils in a relatively low molecular weight range are preferred first additives and amorphous polypropylenes preferred second additives. Other second additives that have been found effective include polyisobutylenes with a viscosity well in excess of 100,000 cS at 20° C., butyl rubber, and ethylenepropylene copolymer and terpolymer rubbers.

The viscoelastic and other physical properties vary significantly with the type of polymer chosen to form the second additive; the polymer preferred may vary with the circumstances.

In most cases I prefer to use an amorphous polypropylene of appropriate molecular weight such as that sold as A-Fax 900DP by Scott-Wise Industries, a Division of Hercules Inc. of Crowley, La. 70526. This provides a range of filling compounds comparable in general physical properties at room temperature with the grades of petroleum jelly currently used in fully-filled cables but adheres more completely to the insulation surfaces without being noticeably more difficult to remove when jointing the cable.

Polyisobutylenes such as that sold under the trademark 'Oppanol B50' (BASF A-G) and butyl rubbers such as that sold under the trademark Polysar PB100 (Polysar Corp.) give a very sticky filling compound that is more difficult and messier to remove for jointing than conventional compounds. These compounds may be preferred for cables of complex construction, e.g. where interstices around or between foil screens need to be filled, and where the need to secure effective filling over-rides the desire for convenience and cleanliness in jointing.

Ethylene-propylene copolymers and terpolymers (such as those sold under the trademarks Vistolon 404 (Exxon) and Keltan 578 (Dutch State Mines) respectively) give compounds that stick less effectively and less permanently to the conductor insulation but which can be removed easily and cleanly. These compounds may therefore be preferred when convenience and cleanliness of jointing (perhaps avoiding the need for protective overalls) is of the first importance and the highest possible standard of resistance to water penetration is not essential.

The compositions may include minor amounts of other additives, such as antioxidants, copper inhibitors and flame retardants.

Determination of molecular weight distributions of the first additive is not necessary, as the suitability of additives and the quantities required can be established by simple screening tests. Since osmotic effects of solutes can be predicted from their effects on a solvent of lower molecular weight, the first additive can be tested using a mobile liquid solvent to obtain results in days rather than weeks; naphtha has been found a very suitable solvent for this purpose.

The amount of each additive required will depend on its nature and to some extent on the nature of the base and of the other additives. In the case of petroleum jelly with the preferred additives an addition of around 5% (by weight referred to the weight of the base) will provide an easily measurable effect, but 20% is often required to obtain a commercially valuable result, and 40% or more can be used in many cases.

All the additives named by way of example can be incorporated into the base by simple stirring above the melting point of the base.

BRIEF DESCRIPTION OF THE DRAWINGS

The invention is illustrated by reference to filling media based on a mineral oil, a viscous polybutene and either an amorphous polypropylene or an ethylene-propylene terpolymer. In the accompanying drawing

Figure 1:
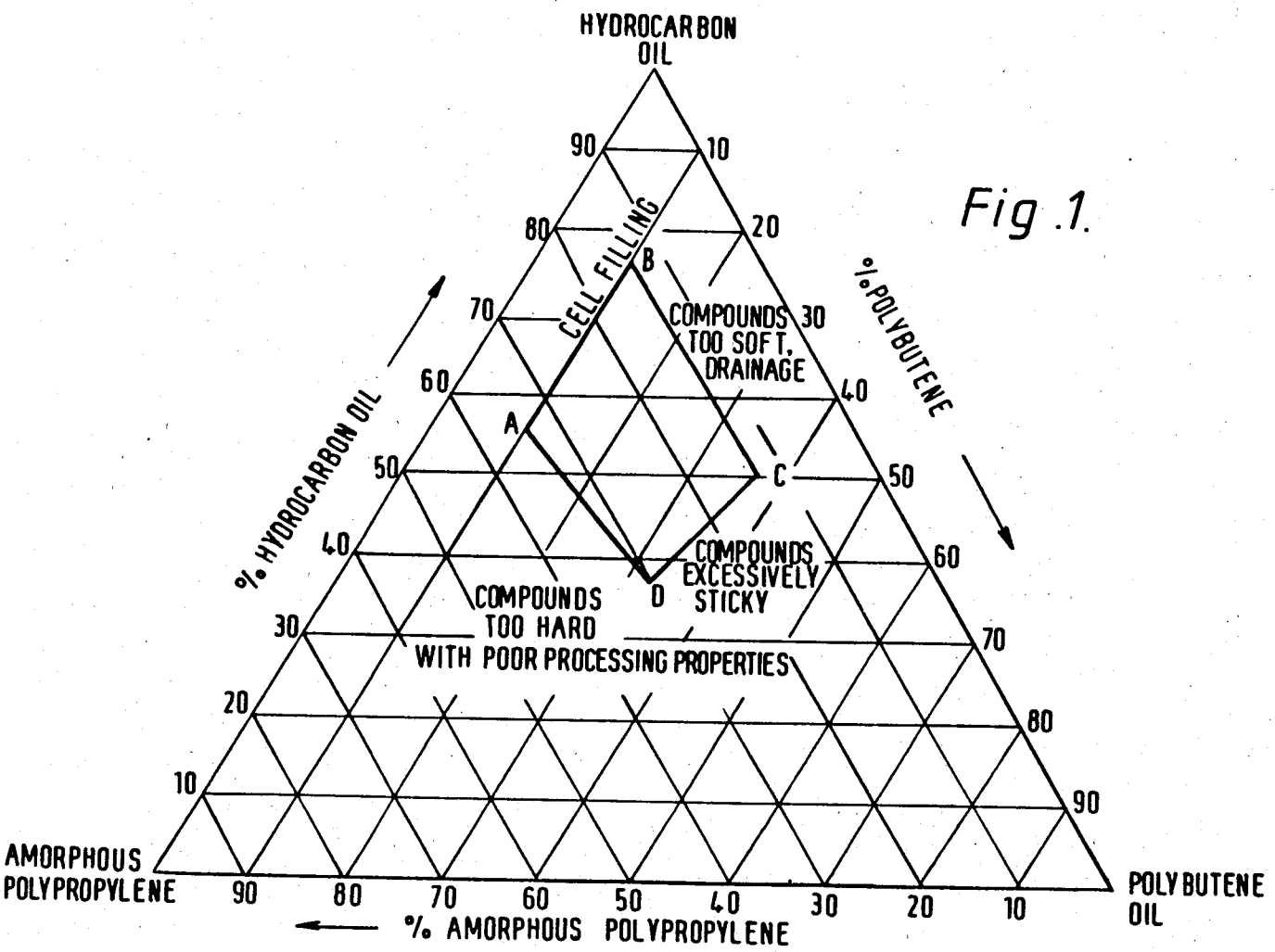
FIG. 1 is a ternary composition diagram for the media including amorphous polypropylene and FIG. 2 a similar diagram for those including ethylene-propylene terpolymer.

In the first series of examples, the base consists of a conventionally refined mineral oil with a viscosity of 300 Saybolt Universal seconds, sold by Dalton & Company Limited of Silkolene Oil Refinery, Belper, Derbyshire, U.K. under the designation "cable compound base oil"; the first additive is a liquid polybutene sold by BP Chemicals Limited of Sully, Penarth, West Glamorgan, U.K. under the Trademark "Hyvis 200" and having a number average molecular weight of about 2,400; and the second additive is an amorphous polypropylene sold under the Trademark "A-Fax 900 DP" having a number average molecular weight of about 3460 and an intrinsic viscosity ([$\eta$]) of 0.51.

From these three ingredients, ten formulations detailed in Table I were prepared, and specimens of cellular polyethylene cable insulation were immersed in each formulation and held at 70° or 80° C. The percentage increase in specific gravity and mass of the insulation specimens were measured after five weeks exposure and in most cases after 20 weeks. The table also gives results of a simple drainage test in which a polyethylene tube 150 mm long and of 3 mm bore was filled with the filling medium formulation and held in a vertical position at the temperature indicated for three days. "No" indicates that the formulation did not drain from the tube and "Yes" that it did. For the sake of perspective, the table also includes some results for specimens similarly treated in three conventional cable filling media and in air. The conventional media are petroleum jelly compounds sold under trademarks as follows:

Compound I: Silkolene 949

Compound II: Silkolene 947 both sold by Dalton and Company Limited

Compound III: Insojel 2460 a high-temperature medium sold by Dussek Campbell Limited of Crayford, Kent, United Kingdom.

TABLE I

| Example of the Invention | Compound Formulation (%) | | | % increase in Specific Gravity of Insulation | | | | % increase in mass of Insulation | | | | Drainage Test | | |
|---|---|---|---|---|---|---|---|---|---|---|---|---|---|---|
| | | | | at 70° C. | | at 80° C. | | at 70° C. | | at 80° C. | | | | |
| | Base | First Additive | Second Additive | 5 weeks | 20 weeks | 5 weeks | 20 weeks | 5 weeks | 20 weeks | 5 weeks | 20 weeks | 65° C. | 70° C. | 80° C. |
| 1.1 | 45 | 26 | 29 | 0.1 | 0.3 | 1.0 | 1.4 | 5.0 | 5.5 | 6.8 | 9.8 | no | no | no |
| 1.2 | 45 | 33 | 22 | 0.0 | 0.0 | 1.2 | 0.1 | 5.5 | 6.1 | 7.1 | 6.3 | no | no | no |
| 1.3 | 52 | 19 | 29 | 0.2 | 0.6 | 0.3 | 0.8 | 6.3 | 6.7 | 7.0 | 7.9 | no | no | no |
| 1.4 | 52 | 26 | 22 | 0.1 | 0.4 | 0.5 | 1.4 | 6.4 | 6.5 | 7.4 | 7.7 | no | no | no |
| 1.5 | 52 | 33 | 15 | 0.9 | 0.7 | 0.3 | 1.4 | 7.0 | 6.4 | 7.7 | 7.5 | no | no | no |
| 1.6 | 59 | 19 | 22 | 1.0 | 1.4 | 2.1 | 0.4 | 7.6 | 7.8 | 10.1 | 8.8 | no | no | no |
| 1.7 | 59 | 26 | 15 | 1.8 | 1.9 | 3.6 | 0.9 | 8.7 | 7.6 | 11.0 | 8.0 | no | no | no |
| 1.8 | 59 | 12 | 29 | | | 0.7 | 0.1 | | | 7.8 | | no | no | no |
| 1.9 | 66 | 12 | 22 | | | 1.9 | | | | 9.5 | | no | no | no |
| 1.10 | 66 | 19 | 15 | | | 0.9 | | | | 8.5 | | no | no | no |
| Known materials for comparison: | | | | | | | | | | | | | | |
| Compound I | | | | 13.3 | 35.2 | | | 34.9 | 60.8 | | | yes | yes | yes |
| Compound II | | | | 6.5 | 33.0 | | | 28.5 | 63.1 | | | yes | yes | yes |
| Compound III | | | | 5.7 | 12.3 | | | 27.1 | 37.5 | | | no | yes | yes |
| Air | | | | 0.6 | | 0.8 | | | | | | | | |

All the examples of the invention included in the table have formulations defined by points within the area ABCD in the drawing; formulations consisting of these three specific ingredients alone and defined by points outside that area are considered unsatisfactory for commercial use, for the reasons indicated in various areas of the drawing; different limitations of composition will of course apply to other materials, even of the same general classes.

In the second series of Examples, the base is the petroleum jelly Silkolene 949 referred to for comparison in Table I; the first additive is again "Hyvis 200"; and the second additive is an ethylenepropylene terpolymer rubber sold under the trademark "Keltan 578" by the Dutch State Mines Company and having a Mooney viscosity (ML 1+4 at 125° C.) of 53.

From these ingredients, twelve compositions were made up as detailed in Table II, which also shows the result of the drainage test as described above, the drop point of the mixture, and comments on compliance with the desired characteristics of resistance to both drainage and cell filling at 70° C., adequate processability and easy removal from the cable insulation. Comments on general characteristics are also included.

TABLE II

| EXAMPLE | COMPOUND FORMULATION (%) BASE | 1ST ADDITIVE | 2ND ADDITIVE | DRAINAGE AT 70° C. | DROP POINT (°C.) | COMPLIANCE | COMMENTS |
|---|---|---|---|---|---|---|---|
| 2.1 | 64 | 20 | 16 | No | 104 | Satisfactory | Firm, low tack. Less easy than base jelly to remove, but leaves clean surface. |
| 2.2 | 68 | 20 | 12 | No | 82 | Satisfactory | Firm, strips easily but leaves slightly tacky surface. |
| 2.3 | 72 | 20 | 8 | Yes | 68 | Drains at 70° C. | Soft, tacky, leaves tacky surface |
| 2.4 | 80 | 12 | 8 | Yes | 66 | Drains at 70° C. | |
| 2.5 | 76 | 12 | 12 | No | 81 | Satisfactory | Firm, low tack. Less easy than base jelly to remove but leaves clean surface. |
| 2.6 | 72 | 12 | 16 | No | 89 | Satisfactory | |
| 2.7 | 68 | 12 | 20 | No | 103 | Too hard, poor processability | Rubbery, peels to leave clean surface. |
| 2.8 | 72 | 16 | 12 | No | 86 | Satisfactory | Firm, low tack. Less easy than base jelly to remove, but leaves clean surface. |
| 2.9 | 64 | 16 | 20 | No | 104 | Too hard, poor processability | Difficult to strip and leaves tacky surface. |
| 2.10 | 60 | 16 | 24 | No | 135 | Too hard, poor processability | |
| 2.11 | 68 | 24 | 8 | Yes | 78 | Drains at 70° C., too tacky for easy removal | Soft, bulk strips easily but a coating remains on surface. |
| 2.12 | 60 | 24 | 16 | No | 100 | Too tacky for easy removal | Leaves tacky surface. |

Figure 2:
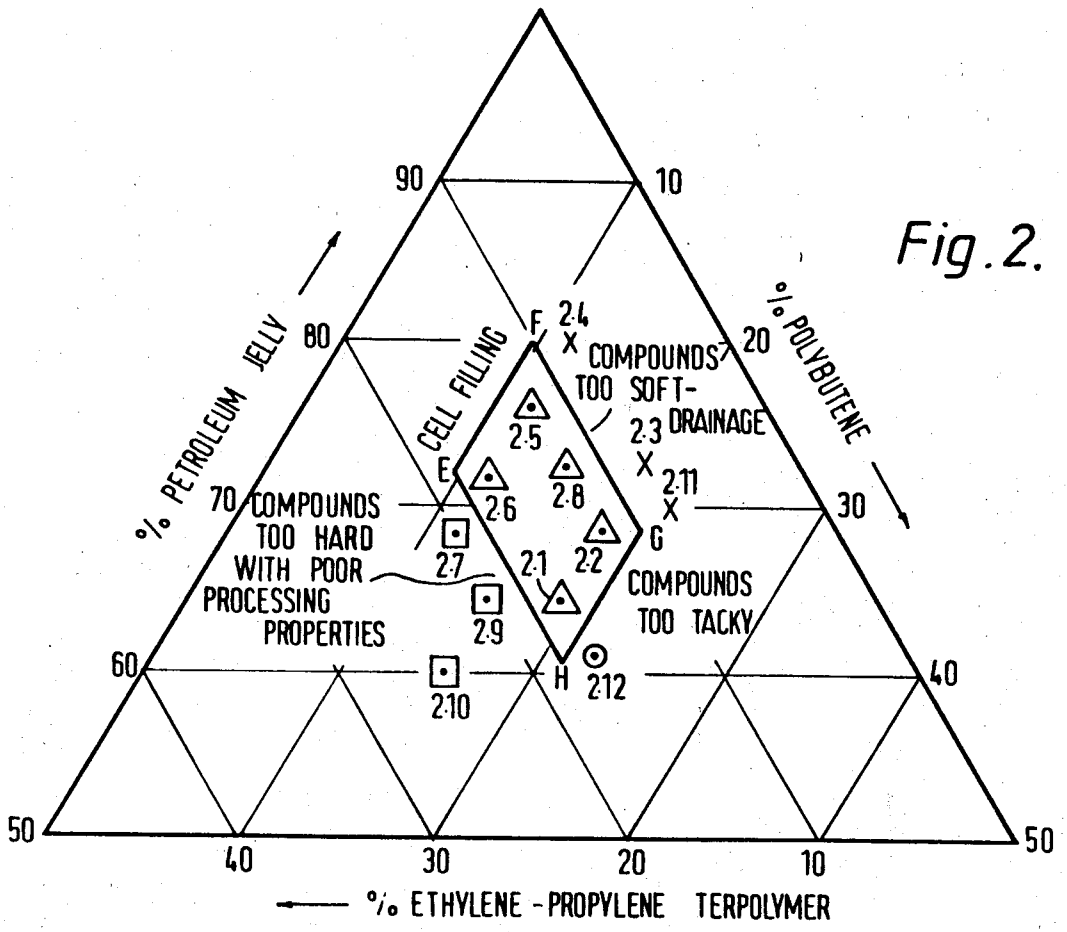

The composition are plotted in the composition diagram of FIG. 2; it will be seen that the five compositions that complied with the desired characteristics (and which are considered commercially satisfactory) fall inside the area EFGH of the drawing; they are in all cases easier to remove from the insulation than any of the compositions set out in Table 1. The seven compositions outside the area EFGH all fail to comply with at least one of the desired characteristics and are considered unsatisfactory.

The water penetration test CW236 of the Post Office Corporation in Great Britain, hereinbefore referred to, is defined as follows:

A circumferential portion of sheath and paper wrapping 25 mm. wide shall be removed from the middle of a 2 meter length of cable and a water tight gland shall be applied over the exposed core so as to bridge the gap in the sheath. The cable shall be supported horizontally and a 1 meter head of water, containing a sufficient quantity of water soluble fluorescent die for the detection of seepage shall be applied to the core for 14 days at a temperature of 20±5° C.

The sheath shall then be removed, the core carefully dissected and examined under ultra-violet light for water penetration. The water penetration shall not exceed 850 mm. in either direction.

What I claim as my invention is:

1. A cable-filling medium having a base comprising a hydrocarbon oil characterised by the use of two non-polar additives, namely:

(i) a first additive which is soluble and consists substantially of molecules that are substantially incapable of diffusing into polyethylene or polypropylene at temperatures of up to 80° C. but having a low (number average) molecular weight such that it will reduce substantially the osmotic pressure of the base, this additive having no appreciable useful effect on the composition's resistance to flow at temperatures in the range 50°-80° C.; and (ii) a second additive which is polymeric and which is also soluble and has a high enough (viscosity average) molecular weight to raise the resistance to flow of the composition so that a cable filled with the composition will pass a water-penetration test as defined in Post Office Telecommunications Specification No. CW236 (issued by the Post Office Corporation in Great Britain) not only at room temperature but also at temperatures up to a limit that is higher than 50° C.

2. A medium as claimed in claim 1 in which the base also includes a gelling agent.

3. A medium as claimed in claim 1, characterised in that both the additives are hydrocarbon polymers.

4. A medium as claimed in claim 1, characterised in that the first additive is a polybutene oil.

5. A medium as claimed in claim 1, characterised in that the second additive is an amorphous polypropylene.

* * * * *